United States Patent [19]

Swope et al.

[11] 4,313,376

[45] Feb. 2, 1982

[54] IMPRINTER

[75] Inventors: Jack G. Swope, St. Ignace; Harry C. Weiss, Moran, both of Mich.

[73] Assignee: Rennco Incorporated, Homer, Mich.

[21] Appl. No.: 129,435

[22] Filed: Mar. 11, 1980

[51] Int. Cl.[3] ..... B41F 1/00; B41F 17/00

[52] U.S. Cl. ..... 101/27; 101/336; 242/75.45; 400/219.3; 400/234; 400/236.2

[58] Field of Search ..... 101/27, 41, 9, 336; 400/219.3, 234, 236.2; 242/75.45

[56] References Cited

U.S. PATENT DOCUMENTS

| | | | |
|---|---|---|---|
| 1,063,263 | 6/1913 | Howe | 242/75.45 |
| 1,822,495 | 9/1931 | Laycock | 242/75.45 |
| 1,925,580 | 9/1933 | Anderson | 242/75.45 |
| 2,035,957 | 3/1936 | Gabrielsen | 101/27 |
| 2,276,980 | 3/1942 | Jacobi | 242/75.45 X |
| 3,120,177 | 2/1964 | Clark | 101/41 |
| 3,128,692 | 4/1964 | Talarico | 101/27 X |
| 3,225,689 | 12/1965 | Fuchs, Jr. et al. | 101/44 |
| 3,244,092 | 4/1966 | Gottscho et al. | 101/27 X |
| 3,304,856 | 2/1967 | Birch | 101/27 |
| 3,331,320 | 7/1967 | Young et al. | 101/292 |
| 4,013,160 | 3/1977 | Colecchi et al. | 242/75.45 X |
| 4,048,913 | 9/1977 | Navi | 101/27 |
| 4,077,187 | 3/1978 | Paxton | 101/27 X |
| 4,121,520 | 10/1978 | Shenoha | 101/41 X |
| 4,160,410 | 7/1979 | Fichter | 101/27 X |

OTHER PUBLICATIONS

Dennison Packaging Systems Advertisement; Control Print Division, 67 Sand Park Road, Cedar Grove, N.J. 07009; Metronic Model M04/M05 Hot Stamp Imprinter.

Gottscho Advertisement; Adolph Gottscho, Inc., 835 Lehigh Ave., Union, N.J. 07083; Wrapaprinta 2222.

Norwood Advertisement; Norwood Model S-44 Large-Area Imprinter; Norwood Marking & Equipment Co. Inc., 2538 Wisconsin Ave., Downers Grove, Ill. 60515.

*Primary Examiner*—Clifford D. Crowder

*Attorney, Agent, or Firm*—Blanchard, Flynn, Thiel, Boutell & Tanis

[57] ABSTRACT

An imprinter having a single driving device for controlling both the movement of the heated printing head and the intermittent advancing movement of the pigmented ribbon. The single driving device, which preferably comprises a reciprocal fluid pressure cylinder, causes the advancing and retracting movement of the printing head. A motion-transfer mechanism drivingly joins the printing head to the take-up reel for the pigmented ribbon. This mechanism is of the one-way type so as to effect rotation of the take-up reel, and advancement of the pigmented ribbon, only when the printing head is being retracted. This mechanism also employs a lost-motion connection therein so that the rotation of the take-up reel is delayed relative to the initial retraction of the printing head, whereby the printing head is initially moved out of engagement with the ribbon prior to the intermittent advancing thereof.

7 Claims, 4 Drawing Figures

IMPRINTER

FIELD OF THE INVENTION

This invention relates to an improved imprinter, often referred to as a hot-stamp imprinter, designed for cooperation with a conventional intermittent packaging machine to enable constant or variable data to be imprinted on commercial packaging or wrapping substances.

BACKGROUND OF THE INVENTION

Numerous machines are available for wrapping or packaging articles or products, which machines utilize various materials such as plastic films, shrink films, paper, coated paper, metal foils and other thin sheetlike substances. These machines, which effect wrapping, bagging or pouch-making, normally operate in an intermittent manner, and numerous varieties of such machines are well known.

To permit more efficient utilization, some of these machines have imprinters mounted on or associated therewith. These imprinters utilize a pigmented ribbon in association with a heated printing head for permitting the desired data to be imprinted on the package or web associated with the packaging machine. In this manner, either constant or variable data, such as information relative to identity, ingredients, quality and manufacturing information, code dating and the like, can be easily and efficiently printed on the packaging material. While several such imprinters are commercially available for use with packaging machines, nevertheless most of the known imprinters have been mechanically and operationally complex. For example, most of the known imprinters have employed a pair of drive mechanisms, one for moving the heated printed head and the other for advancing the pigmented ribbon, thereby complicating the overall assembly and requiring more complex controls. Also, many of the known imprinters have experienced difficulty in controlling the unwinding and feeding of the ribbon during the machine's intermittent operation due to the continually decreasing size of the ribbon spool, and the resulting change in the inertia and movement thereof.

Accordingly, it is an object of the present invention to provide an improved imprinter designed specifically for use on or in association with an intermittent-motion packaging or wrapping machine, which imprinter represents a significant improvement over known imprinters, specifically by improving the imprinter with respect to the known disadvantages mentioned above.

The improved imprinter of the present invention is provided with a single driving device for controlling both the movement of the heated printing head and the intermittent advancing movement of the pigmented ribbon. The single driving device preferably comprises a reciprocal fluid-pressure cylinder for causing the advancing and retracting movement of the printing head. A motion-transfer mechanism drivingly joins the printing head to the take-up reel for the pigmented ribbon. This mechanism is of the one-way type so as to effect rotation of the take-up reel, and advance of the pigmented ribbon, only when the printing head is being retracted. This mechanism also employs a lost-motion connection therein so that the movement of the ribbon is delayed relative to the initial retraction of the printing head, whereby the printing head is initially moved out of engagement with the ribbon prior to the advancing thereof.

The improved imprinter of the present invention also employs a variable braking mechanism associated with the ribbon supply reel, which braking mechanism senses the size of the ribbon spool and imposes a braking force thereon which is approximately proportional to the size of the spool, whereby the braking force is reduced as the spool size is reduced. This controls the rotational movement of the supply spool and prevents inertial overrunning thereof, and also maintains a substantially constant tension in the ribbon withdrawn from the spool.

Other objects and purposes of the present invention will be apparent to persons familiar with apparatus of this type upon reading the following specification and inspecting the accompanying drawings.

Figure 1:
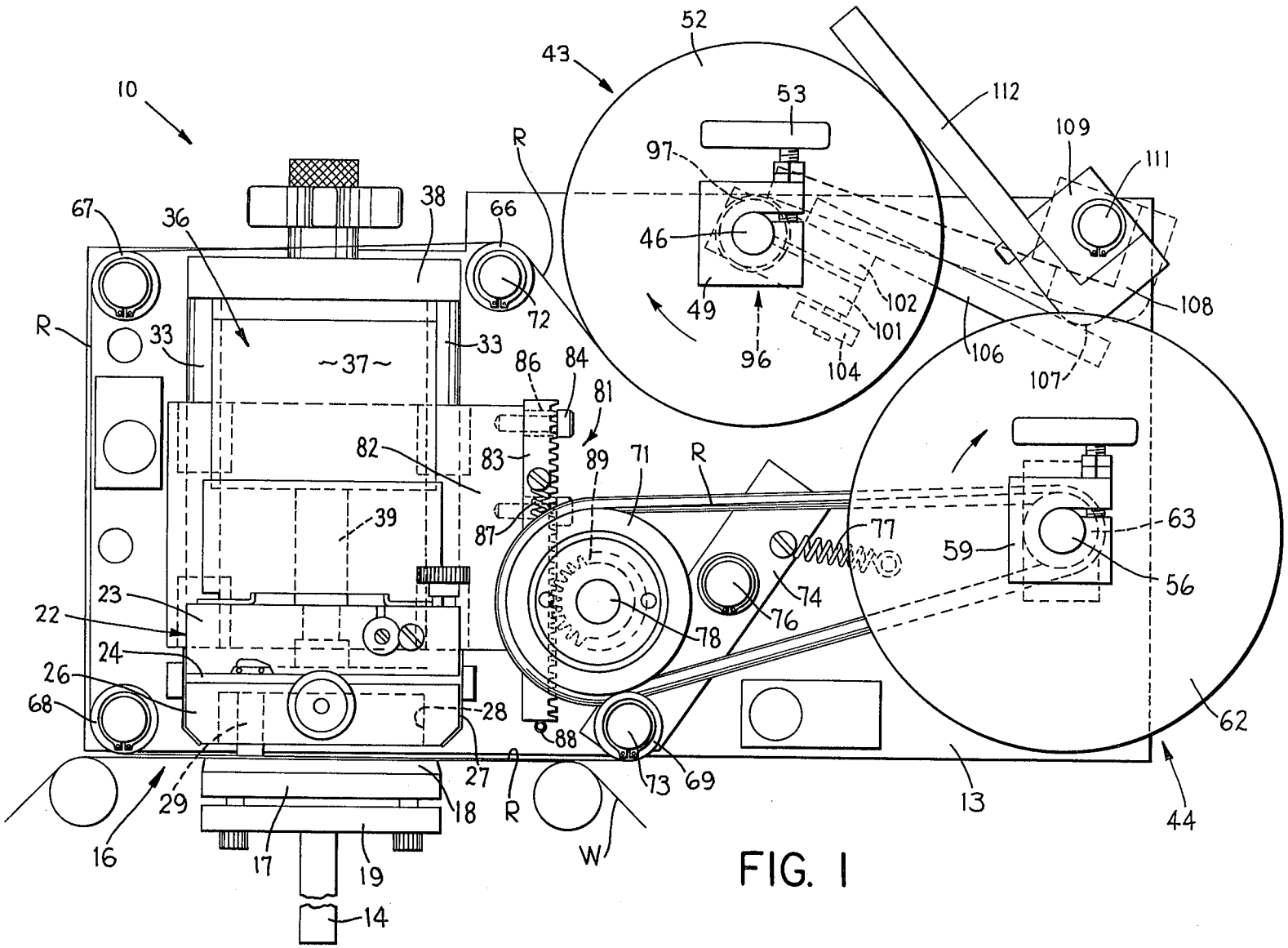
FIG. 1 is a front elevational view of the imprinter according to the present invention.

Certain terminology will be used in the following description for convenience in reference only, and will not be limiting. For example, the words "upwardly," "downwardly," "leftwardly" and "rightwardly" will refer to directions in the drawings to which reference is made. The word "forward" will refer to the normal advancing direction of the pigmented ribbon, and of the packaging web, during normal operation of the imprinter. This word "forward" will also refer to the direction of movement of the printing head as it is being moved into engagement with the ribbon for causing an imprinting operation, the word "rearward" being used to refer to the direction of the printing head away from the ribbon. The words "inwardly" and "outwardly" will refer to directions toward and away from, respectively, the geometric center of the apparatus and designated parts thereof. Said terminology will include the words specifically mentioned, derivatives thereof, and words of similar import.

DETAILED DESCRIPTION

Figure 3:
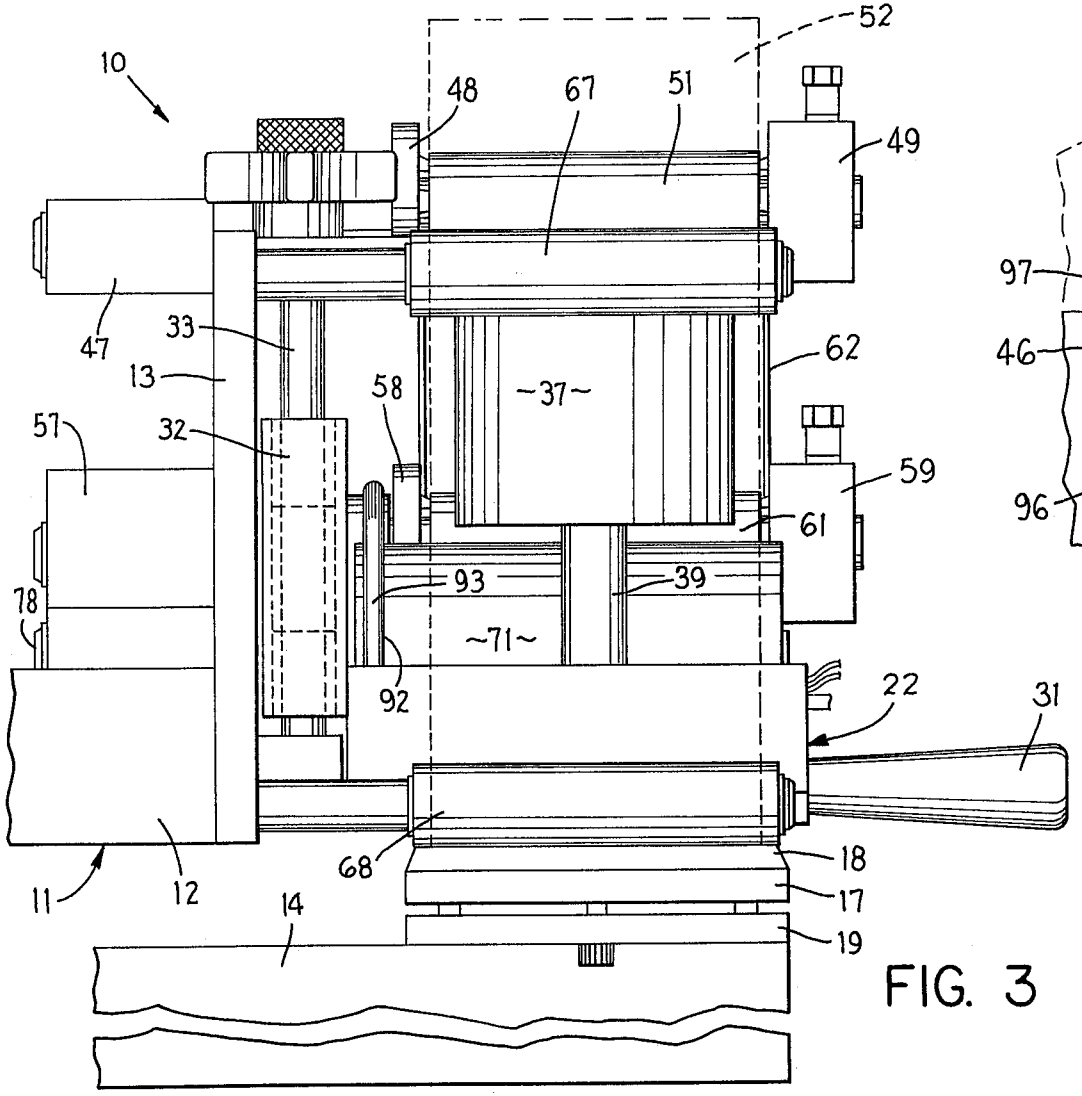
FIG. 3 is a left side elevational view of the imprinter shown in FIG. 1.

Referring to the drawings, there is illustrated the improved imprinter 10 according to the present invention. The imprinter includes a stationary support frame 11 for enabling the imprinter to be mounted directly on, or in close association with, a conventional packaging machine. This support frame 11, in the illustrated embodiment, includes a bracket 12 (FIG. 3) supporting thereon a vertically projecting frame plate 13. A further bracket 14 projects outwardly below the plate 13.

The imprinter has an imprint assembly 16 associated therewith. As shown in FIG. 1, this assembly includes a stationary pressing head or platen 17 which has a conventional stiff but elastically deformable pad 18, such as a rubber pad, associated with the upper surface thereof for defining a supporting surface for the printing ribbon R and packaging web W, as explained hereinafter. The stationary platen 17 is adjustably but stationarily supported on a mounting plate 19 through suitable adjustment screws, this latter plate 19 being fixedly secured to the bracket 14.

Imprint assembly 16 also includes a vertically reciprocal print head assembly 22. The latter is comprised of several parts, including a print head 23 having an electrical heater retainer plate 24 secured to the lower part thereof. A type holder 26 is positioned directly below the heater retainer plate, and is stationarily supported relative to the print head 23 by suitable retainers 27 which are secured to the print head. The type holder 26 has a recess 28 associated therewith and opening downwardly therefrom, which recess supports therein a plurality of conventional but interchangeable type elements 29, the type surfaces or characters of which face downwardly and project through the recess so as to be disposed opposite the lower platen. A suitable handle 31 is fixed to and projects sidewardly from the type holder 26 so that the latter can be slidably displaced sidewardly out from beneath the print head when changing of the type elements 29 is desired. The structure of the type elements 29, and their mounting within the recess of the type holder, is conventional so that further description thereof is believed unnecessary.

The print head assembly 22 is vertically slidably guided so as to be movable toward and away from the stationary platen 17. For this purpose, the print head 23 has a pair of parallel, vertically extending, sleevelike guides or blocks 32 fixed to one side thereof, which guides 32 are vertically slidably supported on vertically extending guide rods 33 which are stationarily supported with respect to the adjacent frame plate 13.

The print head assembly 22 is vertically linearly moved by a motor or drive device 36, the latter preferably comprising a double-acting fluid pressure cylinder of substantially conventional construction. This fluid pressure cylinder 36 has the housing 37 thereof secured to a mounting plate 38 which is stationarily supported from the frame plate 13. The reciprocal piston rod 39 of the cylinder 36 projects vertically downwardly and has the lower free end thereof joined to the print head 23 so as to control the vertical reciprocal movement of the print head assembly 22.

The imprinter 10 also has ribbon supply and take-up assemblies 43 and 44, respectively, associated therewith. These assemblies are individually described hereinafter.

Considering first the ribbon supply assembly 43, same includes an elongated rotatable support shaft 46 which projects horizontally from the frame plate 13 in a cantilevered manner. The shaft 46 is rotatably supported on the frame plate by a conventional bearing block 47. A pair of axially spaced spool hubs, specifically inside and outside spool hubs 48 and 49, respectively, are nonrotatably supported on the shaft 46. These spool hubs 48 and 49 engage the opposite axial ends of the hub or core 51 of a conventional ribbon spool 52 so as to nonrotatably support the ribbon spool on the shaft 46. The outer spool hub 49 is removable from the shaft to enable the ribbon spools to be interchanged, and for this purpose the outer spool hub 49 is formed substantially as a split block (FIG. 1) having a suitable manually adjustable locking screw 53 associated therewith.

The ribbon spool 52 may be of any desired width dependent upon the type of imprinting operation desired. Further, as is well understood, the spool 52 comprises a spirally wound ribbon R, which ribbon may be of any conventional construction (such as a pigmented ribbon) so as to permit a conventional heated imprinting operation to be carried out to thereby effect dry printing on the packaging web.

The ribbon take-up assembly 44 is of generally similar construction, and includes a rotatable support shaft 56 which projects horizontally in a cantilevered fashion from the frame plate 13, being supported thereon by a suitable bearing block 57. This shaft 56 extends parallel with, but is positioned below and sidewardly from, the shaft 46. Inner and outer support hubs 58 and 59, respectively, are nonrotatably mounted on the support shaft 56, the outer support hub 59 being removable to enable the spool of used ribbon to be removed. These hubs 58–59, which identically correspond to the hubs 48–49 described above, engage the opposite axial ends of an empty spool core 61 to hold same nonrotatable with respect to the shaft 56 so that the used ribbon R can be wound therearound. To provide suitable guidance and control over the used ribbon as it is wrapped around the core 61, the inner and outer support hubs 58–59 each preferably have an annular end plate 62 associated therewith, which opposed end plates confine the wound-up ribbon therebetween. The rotation of the ribbon take-up assembly 44 is controlled by means of a driven pulley 63 which is nonrotatably secured to the shaft 56. The pulley 63 is driven as explained hereinafter.

To control the unidirectional advancing movement of the ribbon R from the supply assembly to the take-up assembly, while guiding it through the imprint assembly, the present apparatus provides a system of guide rollers which suitably guide and displace the ribbon R along a desired path. This system of rollers includes a first guide roller 66 positioned adjacent the spool 52, which roller 66 deflects the withdrawn ribbon R so that it passes horizontally over the upper end of the pressure cylinder 36, whereupon the ribbon is deflected downwardly by a second guide roller 67. A third guide roller 68 is positioned downwardly from the guide roller 67 and causes the ribbon R to be deflected horizontally so as to pass over the lower platen 17. A further guide roller 69 is disposed on the opposite side of the head assembly 22 from the roller 68, whereupon this latter roller 69 has the ribbon R wrapped approximately one-half revolution therearound, from which the ribbon then passes around a drive roller 71, and from there the ribbon R extends to the take-up core or spool 61.

The guide rollers 66–69 are all disposed for rotation about substantially horizontal axes, which axes are substantially parallel with one another. Each of the guide rollers 66–68 is suitably rotatably supported on a horizontally-projecting shaft, such as the shaft 72 associated with roller 66, which shaft is fixed to and projects outwardly from the frame plate 13.

The guide roller 69, on the other hand, is rotatably supported on a horizontally projecting shaft 73 which, while it extends parallel with the shaft 72, is fixedly mounted to and projects outwardly from one end of a lever or pivot arm 74. This arm 74 is angularly or pivotally displaceable about the pivot shaft 76 which is fixed to and projects horizontally from the frame plate 13 in parallel relationship to the shafts 72 and 73. A conventional tension spring 77 has one end thereof anchored to the frame plate, and the other end thereof anchored to the upper end of the lever 74, whereby this spring 77 thus continually urges the lever 74 in a clockwise direction as illustrated in FIG. 1, thereby continuously urging the guide roller 69 against the periphery of the drive roller 71 to thus insure that the ribbon R is grippingly engaged between these rollers. The ribbon R engages the drive roller 71 over a substantial angular extent which is preferably in the order of at least one-half revolution. This results in suitable slip-free drivng of the ribbon R so as to effectively withdraw it from the supply spool 52 and supply it to the imprint assembly.

Positive driving of the ribbon R by the drive roller 71 is further insured by providing this drive roller 71 with a suitable non-slip surface. For this purpose, the drive roller 71 preferably has an exterior coating of rubber or other similar elastomeric material.

The rotational driving of the drive roller 71, which effects an intermittent, stepwise, unidirectional advancing of the ribbon R, is controlled by means of a primary motion-transfer mechanism 81, which latter mechanism itself is driven from the fluid pressure cylinder 36 so that the unidirectional intermittent advancing of the ribbon is thus properly synchronized with the imprinting operation.

The motion-transfer mechanism 81 includes means for converting the reciprocal linear movement of the fluid pressure cylinder 36 into intermittent unidirectional rotation of the drive roller 71. This mechanism 81 also includes suitable lost motion during the linear-to-rotary conversion so that the rotational driving of roller 71 occurs through only a portion of the linear stroke. The structure and operation of this mechanism 81 will now be considered.

Figure 2:
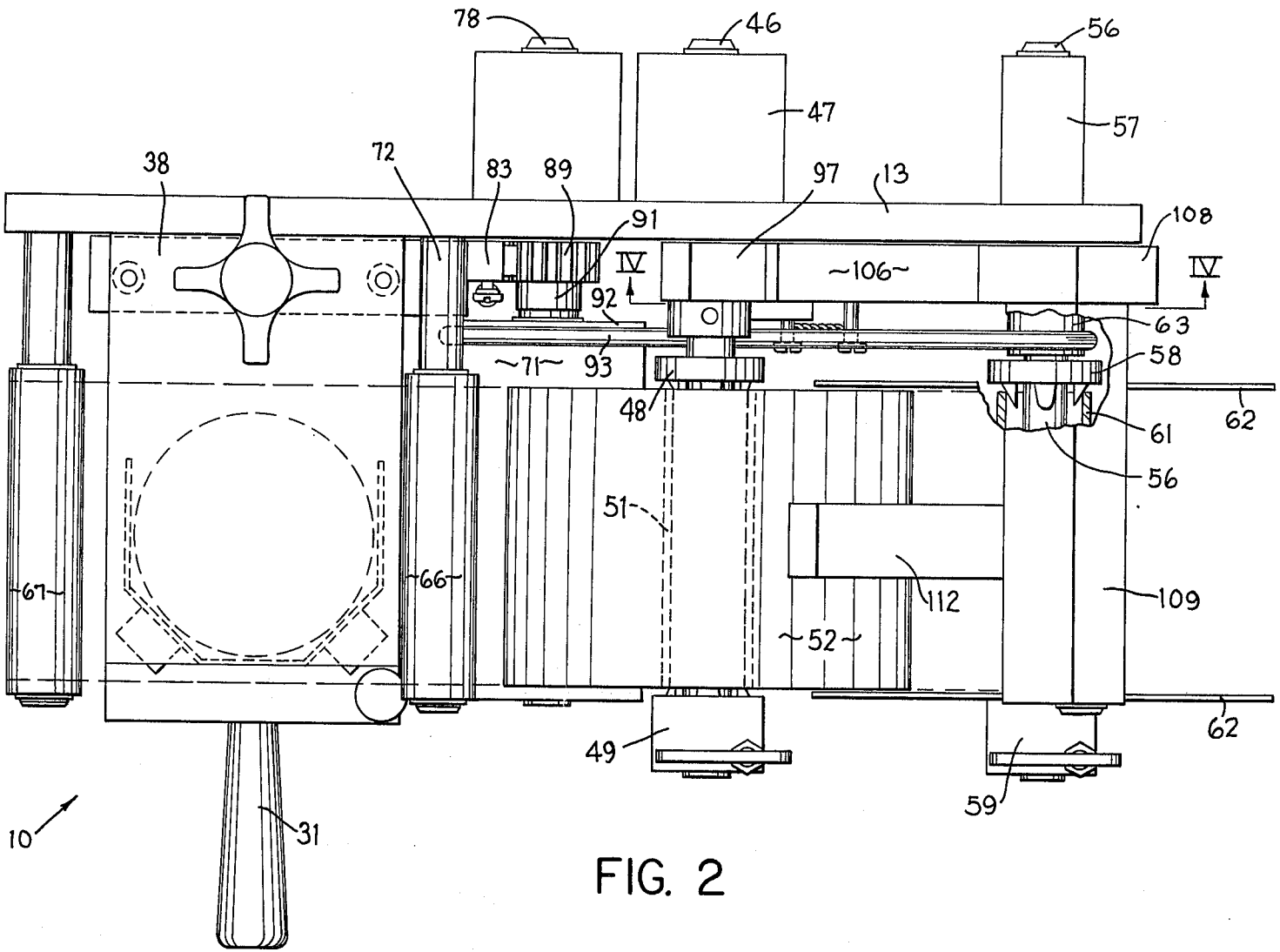
FIG. 2 is a top view of the imprinter shown in FIG. 1.
Figure 4:
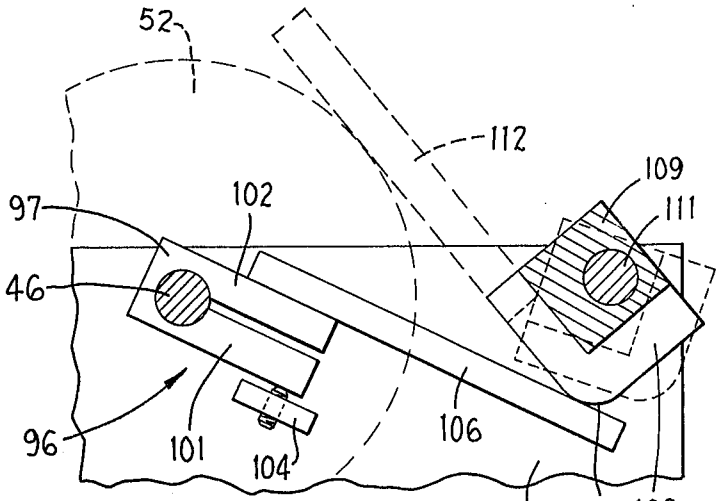
FIG. 4 is a view illustrating the braking mechanism, and is taken substantially along line IV—IV in FIG. 2.

As illustrated in FIGS. 1 and 2, the linear-to-rotary motion conversion is effected by means of a gear-and-rack assembly. For this purpose, the reciprocal print head 23 has a bracket 82 fixed thereto, which bracket in turn supports thereon a vertically elongated gear rack 83. The gear rack 83 extends vertically so as to be disposed in parallel relationship with the direction of movement of the printing head. The gear rack 83 is connected to the bracket 82 by a pair of vertically spaced mounting screws 84, which screws extend through vertically elongated slots or openings 86 formed in the gear rack. These vertically elongated slots 86 thus permit limited vertical displacement of the gear rack 83 relative to the bracket 82, and hence create a lost-motion connection therebetween. A conventional tension spring 87 has one end thereof anchored to the bracket 82, and the other end thereof anchored to the gear rack 83 so that the latter is always resiliently urged downwardly toward its lowermost position, in which position the mounting screws 84 abut against the upper ends of the elongated slots 86. However, when the movable print head assembly 22 approaches its lowermost position, then the lower end of gear rack 83 abuts against a stationary stop pin 88 which projects sidewardly from the frame plate 13. This stop pin 88 prevents further downward displacement of the gear rack 83 so that, when the print head assembly 22 and bracket 82 continue their downward movement, the gear rack 83 is displaced upwardly relative thereto against the urging of the spring 87. This relative displacement of the rack 83 against the urging of the spring 87 is normally limited to a small distance, such as in the order of 1/16 inch.

The gear rack 83 is disposed in continuous meshing engagement with a rotatable gear 89, the latter being coaxial with but freely rotatably supported relative to the drive shaft 78. The gear 89 is drivingly connected to the drive shaft 78 through a conventional one-way clutch 91 so as to effect rotation of the shaft 78, and of the drive roller 71, only when the gear is being rotated (clockwise in FIG. 1) during the retraction (that is, upward) movement of the print head assembly 22.

The motion-transfer mechanism 81 also includes secondary motion-transfer means for causing intermittent unidirectional rotation of the take-up spool assembly 44. For this purpose, the drive roller 71 has a large diameter driving pulley 92 fixedly associated therewith. An endless drive belt 93 extends between and is engaged with the driving and driven pulleys 92 and 63, respectively, so as to effect the desired intermittent rotation of the take-up spool 44. The driven pulley 63 is preferably of substantially smaller diameter than the driving pulley 92, preferably having a diameter no more than one-half that of the driving pulley, so as to enable the drive belt 93 to readily slip with respect to the driven pulley 63 to the extent necessary so as to compensate for the required variable rotation of the take-up spool as the diameter of the used ribbon on the take-up spool increases.

During the intermittent and repetitive withdrawal of ribbon from the supply spool 52, it is important that the rotation of the supply spool be immediately stopped after the preselected quantity of ribbon has been withdrawn, since overrunning of the spool results in undesired slack in the ribbon loop. Maintaining a substantially constant tension in the withdrawn ribbon is thus desired. Overrunning of the ribbon spool, however, has presented a problem since the overrunning is most severe when the spool is of larger diameter due to the larger mass, and hence inertia, of the spool. The overrunning becomes less severe as the spool shrinks in diameter. The present invention thus provides an improved brake mechanism 96 associated with the supply spool 52, which brake mechanism senses the diameter of the supply spool and automatically varies the braking torque applied to the supply spool to prevent overrun thereof irrespective of the spool diameter. This braking mechanism 96 thus effectively results in the braking torque imposed on the supply spool being progressively decreased as the ribbon spool decreases in diameter, and thus results in a substantially constant or uniform tension being maintained in the withdrawn ribbon.

The braking mechanism 96 includes a nylon brake block 97 which has an opening therethrough so that the brake block snugly surrounds the spool support shaft 46. This brake block 97 has a slit or split therein which extends from the periphery thereof into the central opening, whereby the brake block has a pair of opposed arms 101 and 102. The lower arm bears against an adjustable stop screw, which in turn is mounted on a stationary bracket 104 secured to the adjacent side plate 13. The other brake arm 102 has an elongated extension or lever 106 fixed thereto and projecting outwardly therefrom in a direction which is substantially radial with respect to the support shaft 46. The outer end of this brake lever 106 bears against an outer arcuate cam surface 107 formed on a cam 108, the latter being fixedly secured to an elongated pivot block 109 which is freely rotatably supported on the shaft 111, which shaft projects horizontally from the guide plate 13 in parallel relationship to the ribbon guide shaft. The cam surface 107, as measured from the rotational axis defined by shaft 111, is of progressively increasing radius so that as the cam 108 and pivot block 109 rotate counterclockwise in FIG. 1, the radius of cam surface 107 progressively decreases whereby the brake lever 106 is thus permitted to swing progressively upwardly due to the inherent resiliency or elasticity of the brake block 97.

To control the rotation of the cam 108 in response to the decreasing diameter of the ribbon spool 52, the pivot block 109 has an elongated sensor or follower 112 fixed thereto and projecting radially therefrom, whereby this follower 112 adjacent the free end thereof bears against the surface of the ribbon spool 52 and hence senses the diameter of the spool at all times during the operation of the apparatus.

As the diameter of spool 52 decreases, the follower 112 swings downwardly (counterclockwise in FIG. 1) causing a corresponding rotation of the cam 108, which in turn results in the radial distance of the cam surface 107 (at its point of engagement with lever 106) from the pivot axis progressively decreasing. The resiliency of the brake block results in the brake lever 106 continuously bearing against the cam surface 107, whereupon this brake lever 106 thus tends to pivot upwardly, thereby reducing the compression of the brake block and hence reducing the frictional braking torque which the braking block imposes on the shaft 46.

While the operation of the imprinter is believed apparent from the description set forth above, nevertheless the operation relative to the intermittent advancing of the ribbon will be briefly described to insure a complete understanding thereof.

Assuming the imprinter 10 to be in the position illustrated in FIG. 1, the ribbon R which extends between the guide rollers 68 and 69 passes directly over the lower platen 17. Further, a conventional packaging web W (which may be a shrink or plastic film, coated paper, metal foil or the like) also passes directly over the lower platen, this web W being interposed between the pigmented ribbon R and the rubber pad 18. As shown in FIG. 1, the drive cylinder 36 is in its extended position so that the print head assembly 22 is in its extended or lowermost position, the heated type elements 29 thus being pressed against the lower platen with the ribbon R and web W interposed therebetween. This thus effects imprinting of the desired data on the web W. During this imprinting operation, the ribbon R and the web W are maintained stationary. Furthermore, when in this lowermost imprinting position, the gear rack 83 bears against the stop pin 88 so that the gear rack is thus displaced upwardly relative to its support bracket 82 due to extension of spring 87.

After completion of the imprinting operation, pressurized fluid is again supplied to the cylinder 36 so that the print head assembly 22 is moved upwardly out of engagement with the ribbon R. During the initial upward movement of the print head assembly 22, such as during the initial 1/16 inch of movement, the bracket 82 moves upwardly but the gear rack 83 reamins stationarily engaged with the stop pin 88. This initial upward movement of the bracket 82 is permitted by the contraction of the spring 87 back to its normal position. Thus, during this initial upward displacement of the print head out of engagement with the ribbon, the ribbon is not sidewardly driven or displaced, and hence dragging of the ribbon across the type elements is positively prevented.

After the print head assembly has moved upwardly through this initial distance, such that the screws 84 again abut the upper ends of the elongated slots 86, the gear rack 83 is now driven upwardly synchronously with the print head assembly 22. During this latter upward movement, the upward displacement of gear rack 83 causes a clockwise rotation of gear 86. The latter acts through the one-way clutch 91 and causes corresponding clockwise rotation of the rubber drive roller 71 which exerts a driving tension on the ribbon R engaged therewith, thereby causing the ribbon to be unidirectionally advanced so that the used portion of the ribbon as positioned over the stationary platen is withdrawn (moved rightwardly in FIG. 1), whereas a corresponding amount of ribbon is withdrawn from the supply spool 52 so that a new segment of ribbon is thus moved into position over the lower platen. During this advancing of the ribbon, the web W is also suitably advanced by the packaging machine, the drive for the packaging machine being suitably controlled and synchronized with the drive for the imprinter.

The upward displacement of the print head assembly 22, and hence the upward displacement of gear rack 83, continues through a stroke sufficient to cause the desired length of ribbon R to be withdrawn from the spool and advanced into position over the lower platen.

During this advancing of the ribbon caused by rotation of the rubber drive roller 71, the driving pulley 92 is also rotated and, acting through the drive belt 93, causes clockwise rotation of the driven pulley 63 so that the take-up spool is accordingly rotated, thereby causing the used ribbon to be wrapped therearound so as to form a suitable coil or spool. As explained above, the driven pulley 63 can slip relative to the drive belt 93 so as to compensate for the required variable rotation of the take-up spool as the diameter of the ribbon wound therearound increases.

When the print head assembly 22 reaches its uppermost position, the energization of cylinder 36 is reversed, and the print head assembly is now moved downwardly so that the type elements 29 again come into engagement with the new segment of ribbon R which is positioned thereunder, thereby causing imprinting on the underlying web W. During this lowering or advancing of the print head assembly 22, the gear rack 83 is again moved downwardly causing now a counterclockwise rotation of the gear 89. However, due to the presence of the one-way clutch 91, which is ineffective during the counterclockwise rotation of the gear, the rubber drive roller 71 reamins stationary, and hence the ribbon R likewise remains stationary. When the print head assembly 22 closely approaches the lower end of its stroke, then the lower end of gear rack 83 contacts the stop pin 88 which prevents further downward displacement of the gear rack, so that the gear rack remains stationary during the last segment of downward displacement of the print head assembly. The imprinter has thus undergone one complete cycle of operation, as explained above, and is now again in the position illustrated in FIG. 1, such that further cycles of imprinting are then repetitively repeated in the same manner described above.

In the present invention, the length of ribbon R advanced during each cycle can be suitably adjusted as desired merely by controlling the stroke of the print head assembly 22, and hence the stroke of the pressure cylinder 36. This adjustment can be carried out in many ways, such as for example using adjustable stops or limit switches which control or define the stroke limits of the print head assembly.

As is apparent from the arrangement illustrated by FIG. 1, the imprinter of this invention provides a highly desirable compact structure and arrangement. In particular, both the supply and take-up reels for the ribbon are located on one side of the print head assembly, and the ribbon which extends from the supply reel to the take-up reel is effectively formed into a loop which extends around and hence effectively encloses the print head assembly and the drive cylinder therefor. This overall arrangement is extremely compact, provides convenient visibility and accessibility to all components so as to permit the supply and take-up reels to be readily serviced, and permits a new ribbon to be easily fed around the guide rollers and beneath the print head so as to be initially wound around the take-up spool.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In an imprinting apparatus using an imprint ribbon for permitting imprinting of data on a weblike packaging substance, said apparatus including a frame, spool-supporting shaft means rotatably supported on the frame and mounting thereon a spool of said ribbon, take-up reel means rotatably mounted on the frame for winding therearound the used ribbon, guide means disposed for movably guiding the ribbon in a preselected path as the ribbon is withdrawn from the spool and is moved toward said take-up reel means, said guide means maintaining said ribbon straight during a selected part of said path, imprinting means associated with said selected part of the ribbon path for effecting imprinting on said weblike packaging substance, said imprinting means including stationary and movable pressing heads having opposed faces disposed on opposite sides of said ribbon as located in the selected part of said path, said movable pressing head being slidably guided for linear displacement in a direction substantially perpendicular to said ribbon, said movable pressing head also having type means associated with the face thereof, and motor means connected to said movable pressing head for linearly reciprocating same between extended and retracted positions, said movable pressing head when in said extended position being disposed in pressing engagement with said stationary pressing head so as to press said ribbon and said weblike packaging substance therebetween, said movable pressing head when in said retracted position being spaced from both said stationary pressing head and said ribbon, the improvement comprising:

a rotatable drive roller disposed in direct driving engagement with said ribbon downstream of said imprinting means but upstream of said take-up reel means for effecting displacement of said ribbon along said path, and withdrawal of ribbon from said spool, in response to rotation of said roller;

primary motion-transfer means drivingly connected between said movable pressing head and said drive roller for causing intermittent unidirectional rotation of the latter in response to reciprocating movement of said movable pressing head, whereby said ribbon is intermittently and unidirectionally movably displaced along said path through a preselected distance;

said primary motion-transfer means including one-way means for effecting intermittent unidirectional rotation of said drive roller only when the movable pressing head is being linearly displaced in one direction, said one-way means enabling the drive roller to remain stationary when the movable pressing head is being linearly displaced in the opposite direction;

said primary motion-transfer means also including a linear gear rack mounted on said movable printing head and disposed in meshing engagement with a rotatable gear, said rotatable gear being drivingly interconnected to said drive roller through said one-way means;

said primary motion-transfer means further including lost-motion means associated therewith for permitting at least limited linear displacement of the movable pressing head in said one direction without causing a corresponding rotation of the drive roller, whereby said lost-motion means results in the rotation of the drive roller occurring over only a fraction of the stroke of the movable pressing head in said one direction;

said lost-motion means comprising connecting means coacting between said gear rack and said movable pressing head for permitting limited relative reciprocal movement therebetween in a direction substantially parallel to the direction of movement of said movable pressing head, biasing means coacting with said gear rack for normally maintaining same in an end position relative to the movable pressing head, and stationary stop means positioned for engagement with said gear rack to movably displace same against the urging of said biasing means when said movable pressing head is positioned at or closely adjacent said extended position; and secondary motion-transfer means drivingly connected to said take-up reel means for causing intermittent unidirectional rotation thereof.

2. An apparatus according to claim 1, wherein said one-way means effects rotation of the drive roller during the retraction stroke of said movable pressing head when the latter is being moved toward its retracted position, and said lost-motion means preventing rotation of said drive roller during the initial displacement of the movable printing head away from said extended position so that the ribbon remains stationary during this initial displacement.

3. An apparatus according to claim 1 or claim 2, wherein said secondary motion-transfer means includes a driving pulley connected to and rotatable with said drive roller, a driven pulley connected to said reel means for rotating same, and an endless belt extending between and being drivingly engaged with said driving and driven pulleys, the driven pulley being of substantially smaller diameter than said driving pulley to permit relative slippage to occur between said drive belt and said driven pulley whereby the rotational speed of said reel means can vary so as to compensate for the variable size of the ribbon spool wrapped therearound.

4. An apparatus according to claim 1, wherein said motor means comprises a linear fluid pressure cylinder means having a linearly reciprocal piston rod projecting therefrom and connected to said movable pressing head, said take-up reel means and said spool-supporting shaft means, including the ribbon spool mounted thereon, both being disposed adjacent one side of said fluid pressure cylinder means and said movable pressing head, and the path of said ribbon as it extends from said spool to said take-up reel means comprising a loop which extends around and partially encloses said fluid pressure cylinder means and said movable pressing head.

5. An apparatus according to any one of claim 1 or claim 2, including variable brake means associated with said spool-supporting shaft means for applying a braking torque thereon so as to control the tension of the ribbon withdrawn from said spool, sensing means coacting with the ribbon spool for sensing the decrease in the diameter thereof as the ribbon is withdrawn, and control means responsive to said sensing means for automatically adjusting said brake means to reduce the braking torque imposed on said spool-supporting shaft means as the diameter of the ribbon spool decreases, whereby the tension of the ribbon withdrawn from the spool remains relatively uniform even through the spool diameter continues to decrease.

6. An apparatus according to claim 5, said brake means including a blocklike brake member having an opening therethrough for accommodating therein the spool-supporting shaft means, the brake member having a slit which extends radially thereof from said opening to the external periphery thereof so that the brake member defines a pair of opposed leg portions disposed on opposite sides of said slit, one of said leg portions being fixed with respect to the frame, the other leg portion being resiliently deflectable toward the fixed leg portion so as to increase the clamping of the brake member relative to the shaft means to thereby cause a corresponding increase in the braking torque, said control means including cam means rotatable about an axis which is parallel to but spaced from the axis of said shaft means, said cam means having an eccentric cam surface disposed in bearing engagement with said other leg portion of said brake member, and said sensing means including a follower connected to said cam means and projecting therefrom for bearing engagement with said ribbon spool adjacent the upper portion thereof, whereby said follower pivotally moves said cam means in response to a decrease in the diameter of said spool so as to cause a corresponding movement of said other leg portion of the brake member to thereby progressively decrease the braking torque imposed on the spool-supporting shaft means.

7. In an imprinting apparatus using an imprint ribbon for permitting imprinting of data, said apparatus including a frame, spool-supporting shaft means rotatably supported on the frame and mounting thereon a spool of said ribbon, guide means for movably guiding the ribbon in a preselected path as the ribbon is withdrawn from the spool, imprinting means associated with a selected part of the ribbon path, said imprinting means including a pair of pressing heads having opposed faces disposed on opposite sides of said ribbon as located in the selected part of said path, and means connected to one said pressing head for reciprocating same between first and second positions, said one pressing head when in said first position being disposed in pressing engagement with said ribbon, said one pressing head when in said second position being spaced from said ribbon, the improvement comprising:

a rotatable drive member disposed in driving engagement with said ribbon for effecting displacement of said ribbon along said path, and withdrawal of ribbon from said spool, in response to rotation of said drive member;

motion-transfer means drivingly connected between said one pressing head and said rotatable drive member for causing intermittent unidirectional rotation of the latter in response to reciprocating movement of said one pressing head, whereby said ribbon is intermittently and unidirectionally movably displaced along said path through a preselected distance;

said motion-transfer means having lost-motion means associated therewith for permitting at least limited displacement of said one pressing head in said one direction without causing a corresponding rotation of the drive member, whereby said lost-motion means results in the rotation of the drive member occurring over only a fraction of the stroke of said one pressing head in said one direction;

said motion-transfer means including a gear rack mounted on said one pressing head and disposed in meshing engagement with a rotatable gear, said rotatable gear being drivingly interconnected to said drive member; and said lost-motion means comprising connecting means coacting between said gear rack and said one pressing head for permitting limited relative reciprocal movement therebetween in a direction substantially parallel to the direction of movement of said one pressing head, biasing means coacting with said gear rack for normally maintaining same in an end position relative to said one pressing head, and stop means for engagement with said gear rack to movably displace same relative to said one pressing head against the urging of said biasing means when said one pressing head is positioned at or closely adjacent said first position.

* * * * *